US011135868B2

(12) United States Patent
Ikai

(10) Patent No.: US 11,135,868 B2
(45) Date of Patent: Oct. 5, 2021

(54) REFILL FOR WRITING IMPLEMENTS AND WRITING IMPLEMENTS USING THE SAME

(71) Applicant: MITSUBISHI PENCIL COMPANY, LIMITED, Tokyo (JP)

(72) Inventor: Takayuki Ikai, Yokohama (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 16/480,160

(22) PCT Filed: Mar. 19, 2018

(86) PCT No.: PCT/JP2018/010746

§ 371 (c)(1),
(2) Date: Jul. 23, 2019

(87) PCT Pub. No.: WO2018/180679

PCT Pub. Date: Oct. 4, 2018

(65) Prior Publication Data

US 2019/0337323 A1 Nov. 7, 2019

(30) Foreign Application Priority Data

Mar. 31, 2017 (JP) ..... JP2017-069992

(51) Int. Cl.
*B43K 7/08* (2006.01)

(52) U.S. Cl.
CPC ..... *B43K 7/08* (2013.01)

(58) Field of Classification Search
CPC ..... B43K 1/08
(Continued)

(56) References Cited

U.S. PATENT DOCUMENTS 5,899,618 A 5/1999 Kobayashi et al.
9,636,940 B2 * 5/2017 Kamitani ..... B43K 7/10
(Continued)

FOREIGN PATENT DOCUMENTS

CN 1112489 A 11/1995
CN 1438128 A 8/2003
(Continued)

OTHER PUBLICATIONS

International Search Report dated May 1, 2018, issued in counterpart application No. PCT/JP2018/010746 (2 pages).
(Continued)

*Primary Examiner* — Lori L Baker
(74) *Attorney, Agent, or Firm* — Westerman, Hattori, Daniels & Adrian, LLP

(57) ABSTRACT

A refill for writing implements has an ink reservoir tube (1) made of resin material and formed to be a straight cylinder and a writing tip (2) attached to one end of the ink reservoir tube (1), and a value of an expression of $D^4-(D-2t)^4$ is selected to be 45 or greater, where D denotes an outer diameter of the ink reservoir tube (1) and t denotes a thickness of the ink reservoir tube (1). It is possible to secure the necessary storage amount of ink in the ink reservoir tube (1) without increasing the outer diameter thereof, and is also possible to provide a refill for a writing implement and a writing implement which allow one to keep writing comfortably without feeling of discomfort in writing.

15 Claims, 7 Drawing Sheets

(58) Field of Classification Search
USPC ..... 4/209, 348, 217–218; 285/42; 454/1
See application file for complete search history.

(56) References Cited

U.S. PATENT DOCUMENTS

| | | | | |
|---|---|---|---|---|
| 2007/0189836 | A1* | 8/2007 | Senga | B43K 7/10 401/195 |
| 2008/0219746 | A1* | 9/2008 | Lee | B43K 1/08 401/6 |
| 2017/0151823 | A1* | 6/2017 | Nakamura | B43K 1/086 |

FOREIGN PATENT DOCUMENTS

| | | | |
|---|---|---|---|
| CN | 1756670 | A | 4/2006 |
| CN | 1774347 | A | 5/2006 |
| CN | 104837642 | A | 8/2015 |
| CN | 107848324 | A | 3/2018 |
| EP | 1 607 238 | A1 | 12/2005 |
| EP | 2 933 117 | A1 | 10/2015 |
| EP | 2933117 | A1 | 10/2015 |
| GB | 263 341 | A | 12/1926 |
| GB | 688892 | A | 3/1953 |
| JP | 2000-198291 | A | 7/2000 |
| JP | 2000198291 | A | 7/2000 |
| JP | 2002-52885 | A | 2/2002 |
| JP | 2002-59682 | A | 2/2002 |
| JP | 2011-212941 | A | 10/2011 |
| JP | 2014-162138 | A | 9/2014 |
| JP | 2014162138 | A | 9/2014 |
| WO | 2007/112658 | A1 | 10/2007 |
| WO | 2017/061570 | A1 | 4/2017 |

OTHER PUBLICATIONS

Office Action dated Aug. 28, 2020, issued in counterpart CN Application No. 201880023144.5, with English translation (17 pages).

Supplementary European Search Report dated Nov. 16, 2020, issued in counterpart EP Application No. 18776233.1. (13 pages).

Extended (Supplementary) European Search Report dated Mar. 16, 2021, issued in counterpart EP Application No. 18776233.1. (12 pages).

* cited by examiner

REFILL FOR WRITING IMPLEMENTS AND WRITING IMPLEMENTS USING THE SAME

TECHNICAL FIELD

The present invention relates to a refill for a writing implement, such as a ballpoint pen, and writing implements using the refill.

DESCRIPTION OF THE RELATED ART

A ballpoint pen tip as a writing tip is typically mounted by press-fitting to a foremost end of an ink reservoir tube of a refill for a writing implement for such as ballpoint writing implements. The ink reservoir tube is made of transparent or semi-transparent resin material, such as polypropylene, for easiness of forming and better visibility of the amount of ink.

A cross sectional view of an example of a conventional ballpoint pen refill is shown in FIG. 17. In the example shown in FIG. 17, the structure of the refill is shown where a ballpoint pen tip is attached through a joint member 3 to a front end of an ink reservoir tube cylindrically formed. An outer circumferential surface of the ink reservoir tube 1 is formed to be a cylinder flush with an outer circumferential surface of the joint member 3.

The inner diameter of the front end of the ink reservoir tube 1 to which the joint member 3 to be fitted is substantially same as the inner diameter of the central portion constituting an ink containing portion along the axial direction of the ink reservoir tube.

Such a ballpoint pen refill with an ink reservoir tube whose outer and inner circumferential surfaces are straight in shape is disclosed in a Patent Literature 1, for example.

In the above-described ballpoint pen refill, a front end of the ink reservoir tube to which a ballpoint pen tip is fitted necessarily has a certain thickness to secure fitting strength. According to the ballpoint pen refill having the structure disclosed in the Patent Literature 1, there arises a practical problem where an amount of stored ink is not sufficiently secured due to a constant thickness over the entire length of the ink reservoir tube.

Adoption of thin-walled ink reservoir tube enables to sufficiently secure a necessary amount of ink stored without increasing the outer diameter of the tube. The thin-walled ink reservoir tube, however, may fail to secure a sufficient fitting force against the ballpoint pen tip or the joint member to be attached at the front end of the ink reservoir tube and may cause to rise a problem that the ballpoint pen tip easily comes off from the ink reservoir tube.

To prevent the ballpoint pen tip coming off from the ink reservoir tube, proposed is a ballpoint pen refill in which an annular groove is formed on the outer circumferential surface of the ballpoint pen tip and in which an annular protrusion is formed on the inner circumferential surface of the joint member which is to be fitted into the ink reservoir tube. This feature is disclosed in a Patent Literature 2.

The function disclosed in the Patent Literature 2, however, is related to consideration for press-fitting between a ballpoint pen tip and a joint member. Even though the structure disclosed in the Patent Literature 2 is adopted as it is for detach prevention function of the ballpoint pen tip or the joint member from the ink reservoir tube having a thinned wall, it is difficult to show the improving effect.

PATENT LITERATURE

Patent Literature 1: JP 2002-59682
Patent Literature 2: JP 2002-52885

SUMMARY OF THE INVENTION

Problem to be Solved

In addition to the practical problem described above, where an amount of stored ink is not sufficiently secured due to a constant thickness over the entire length of the ink reservoir tube, another problem arises that an ink reservoir tube made of famed resin material comes to be easily deformed excessively. Namely, when the ink storage tube is defamed excessively due to the writing pressure from the writing chip, there arises a problem that the feeling of writing becomes uncomfortable.

Consequently, it is a problem to provide a refill for writing implements and implements using the same, which are devised for continue writing comfortably without causing uncomfortable feeling of writing, where a necessary amount of ink stored is secured without increasing the outer diameter of the ink reservoir tube.

Method for Solving the Problem

A refill for writing implements according to the present invention to solve the above problem is a refill for writing implements, having an ink reservoir tube formed of a resin material into a straight cylinder shape and a writing tip attached to one end of the ink reservoir tube; a value given by $[D^4-(D-2t)^4]$ is equal to or larger than 45, where D (mm) and t (mm) are an outer diameter and a thickness of the ink reservoir tube, respectively.

At one end of the ink reservoir tube, a press-fit part is formed, whose thickness is thickened toward an inner circumferential surface and which has an opening penetrating in an axis direction at the center. A structure of the refill can be adopted in which the writing tip or a joint member supporting the writing tip is attached by press-fitting to the press-fit part.

In a preferred embodiment, it is preferred that a joint member supporting the writing tip is attached to the inner circumferential surface of the ink reservoir tube, an ink back-flow prevention mechanism is provided in the joint member, and the ink reservoir tube contains propylene homopolymer as a composition.

It is desirable that the thickness of the press-fit part at an end of the ink reservoir tube ranges 0.5 mm to 0.7 mm, or more preferably 0.55 mm to 0.65 mm, and that an axial length of the press-fit part ranges 1.0 mm to 6.0 mm, or more preferably 2.5 mm to 4.5 mm.

Refills for writing implements are preferably used in a construction where a plurality of refills are housed in a barrel and a writing tip of one of the refills advances alternatively from a top end opening of the barrel.

In addition, in a writing implement that houses refills for writing implements in a barrel according to the present invention, it is preferable that a fitting force between the writing tip or the joint member supporting a writing tip and a connecting portion of the ink reservoir tube is larger than a fitting force between the ink reservoir tube and the connecting portion of the ink reservoir tube with the barrel.

Further, as for a writing implement that houses a plurality of refills for writing implements in the barrel, it is desirable that the outer diameter and length of each ink reservoir tube of the plurality of refills for writing implements are set to be equal and, at the same time, writing distance of refills for writing implements is set to fall in a range of 1.5 to 2.5 to each other by varying the wall thicknesses of the ink reservoir tubes.

Effect of Invention

As for the refills according to the present invention for writing implements and writing implements using the refill, the ink reservoir tube is made of resin material and formed in a straight cylinder, and a writing tip or a joint member holding a writing tip is press-fittedly attached to an end of the ink reservoir tube. Then, by setting the relationship between the outer diameter D [mm] and the thickness t [mm] of the ink storage tube in the above-described specific range, it is possible to secure the necessary storage amount of ink in the ink reservoir tube. In addition, according to the above configuration, it is possible to provide a refill for a writing implement and a writing implement which allow one to keep writing comfortably without feeling of discomfort in writing.

A press-fit portion is formed whose thickness is thickened toward an inner circumferential surface and at the center of which a penetrating opening is bored. A writing tip or a joint member holding a writing tip is press-fitted to the press-fit portion; consequently sufficiently high strength of attachment of the tip or the joint member is secured. This enables to secure a sufficient amount of stored ink without increasing the outer diameter size of the ink reservoir tube.

BRIEF DESCRIPTION OF THE DRAWINGS

A refill for a writing implement according to the present invention will be described on the basis of an embodiment shown in drawings of a ballpoint pen refill for example. FIGS. 1 to 4 show a first embodiment of a ballpoint pen refill; a joint member 3 to which a ballpoint pen tip 2 is attached is press-fitted to an end (a front end) of an ink reservoir tube 1 that is formed of resin material into a cylinder as shown in FIGS. 1 and 2. Ink 4 is stored in the ink reservoir tube 1, and at the end of the ink a grease-like or gel-like follower 5 is disposed which follows the ink in contact with the ink surface, as the ink is consumed. FIGS. 1 and 2 show a situation in which ballpoint pen tip 2 is covered with a cap 6 made of resin.

The ink reservoir tube 1 is made of resin containing polypropylene monomer and with the ink reservoir tube with this monomer a degree of deformation due to a stress of writing pressure is reduced and further an amount of remaining ink stored can be clearly seen. In addition, as for transmissivity of ink solvent and water absorptiveness, the ink reservoir tube can have property of a certain level of transmissivity and moisture absorption resistance, and has a high storage performance of the ink.

Consequently it is possible to provide a ballpoint pen refill which can bear the fitting-in pressure at a press-fit portion to which a writing tip 2 or a joint member 3 is press-fitted; the press-fit portion will be described later.

Figure 2:
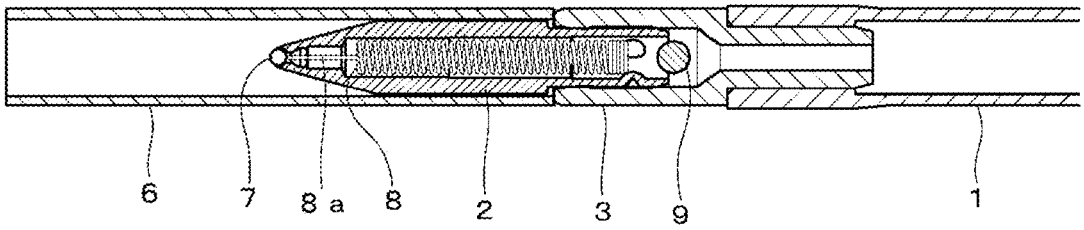
FIG. 2 is an enlarged cross-sectional view of the ballpoint tip shown in FIG. 1.

As shown in FIG. 2 where the ballpoint pen tip 2 and the joint member 3 are drawn enlarged, a well-known writing ball is attached to a tip end of the ballpoint pen tip 2; a spring 8 is disposed in an inner space of the ballpoint pen tip 2. A tip end 8*a* of the spring 8 is formed to be a straight rod, pressing the writing ball 7 to the tip end direction. A part of a rear end of the ballpoint pen tip 2 is squeezed inward, the squeezed portion locks a rear end portion of the spring 8.

In the joint member 3 fittedly supporting the ballpoint pen tip 2, a backflow preventing ball 9 is housed. The backflow preventing ball 9 works to prevent ink 4 flowing backward in the ink reservoir tube 1 due to inflow of air from the tip end of the ballpoint pen tip 2 when a ballpoint pen is kept with the ballpoint pen tip upward.

Figure 3:
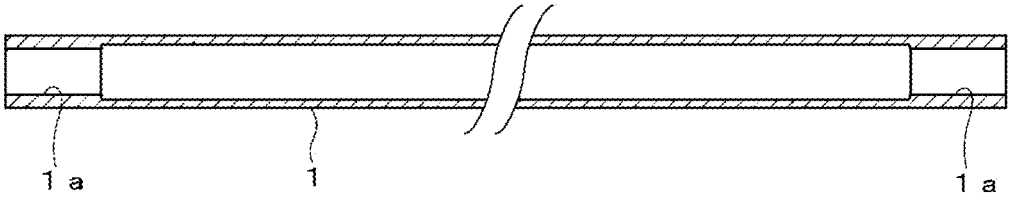
FIG. 3 is a central cross-sectional view of an enlarged single unit of an ink reservoir tube shown in FIG. 1.

The ink reservoir tube 1 is formed in a cylinder shape whose outer circumferential surface is made approximately flush along the axis direction. As shown in an enlarged view of both ends in FIG. 3, at the both ends of the ink reservoir tube 1, a press-fit portion 1*a* whose thickness is thickened toward an inner circumferential surface and the ink reservoir tube 1 are integrally formed. The press-fit portion is composed of a through hole bored at the center of the thickened portion along the axial direction. A joint member 3 is press-fitted to one end of the press-fit portion 1*a*, and a ballpoint pen tip 2 is attached to a front end of the ink reservoir tube 1 via the joint member 3.

Figure 17:
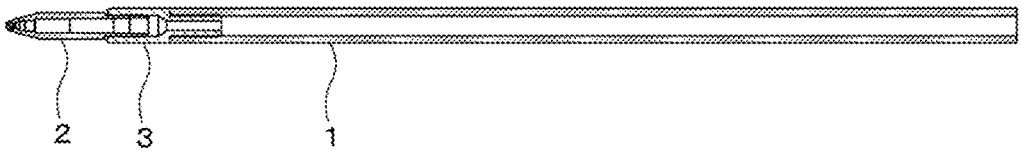
FIG. 17 is a central cross-sectional view of an example of a conventional refill for writing implement.

A ballpoint pen refill shown in the present example can secure a sufficient mechanical strength of an attaching part of the joint member 3 because the press-fit portion 1*a* made on an end of the ink reservoir tube 1 is formed to be thickened toward an inner circumferential surface. Therefore, the thickness of the ink reservoir tube 1 can be thinner except the press-fit portion relatively in comparison to a conventional examples shown in FIG. 17. This configuration enables to secure the necessary amount of ink stored without increasing the thickness of the ink reservoir tube 1.

Figure 4:
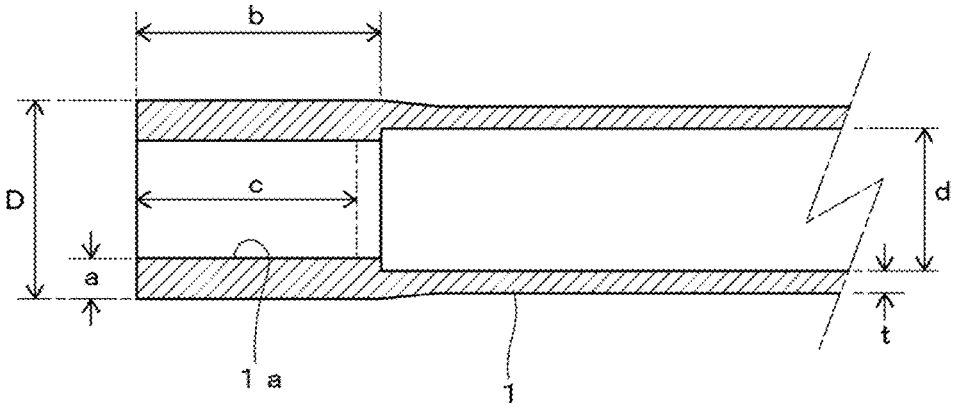
FIG. 4 is an enlarged cross-sectional view of a press-fit portion of a joint member of the ink reservoir tube shown in FIG. 1.

FIG. 4 shows a desirable dimension of each portion and relations therebetween of the press-fit portion 1*a*, to which the joint member 3 is attached, of the ink reservoir tube 1; in the FIG. 4 D ranges 2.5 mm to 3.6 mm, favorably 2.9 mm to 3.2 mm, t ranges 0.25 mm or thicker, favorably 0.3 mm to 0.6 mm, a ranges 0.5 mm to 0.7 mm, favorably 0.55 mm to 0.65 mm, b ranges 1.0 mm to 6.0 mm, favorably 2.5 mm to 4.5 mm, and c ranges 1.0 mm to 6.0 mm, favorably 2.5 mm to 4.5 mm, where D denotes an outer diameter of an ink reservoir tube, t denotes a thickness of the ink reservoir tube, a denotes a thickness of the press-fit portion, b denotes a length of the press-fit portion, and c denotes a contacting length of press fitting.

A product $a \times b(D-a)$ ranges 1 to 12, favorably 3 to 8; if the value is smaller than unity (1), necessary fitting force with the writing tip is not available, and not smaller than 12, it may fail to press-fit because of too large press-fitting force necessary to attach the writing tip.

A value of $[D^4-(D-2t)^4]$ is equal to or more than 45, favorably more than 55.

As for the outer diameter D of the ink reservoir tube, the larger its outer diameter is, the more stored ink is secured; however, the outer diameter D of the ink reservoir tube is favorably equal to or less than 3.6 mm in order to use without a sense of incongruity in comparison to conventional writing implements.

The reason why the above stated range is favorable is that when the thickness of the ink reservoir tube 1 excluding the press-fit portion 1*a* is larger than 0.6 mm, in the favorable range of the outer diameter D of the ink reservoir tube, arises a problem that a necessary amount of stored ink is not available, and writing blur occurs when the writing speed is fast.

The rationale that the value of $[D^4-(D-2t)^4]$ is equal to or more than 45, favorably more than 55 as described above is based on the results of measurements of degree of defamation of the ink reservoir tube 1 when writing pressure is applied, which measurement is performed with a commercially available compression load measuring instrument, such as TENSILON Universal Material Testing Instrument.

Figure 5:
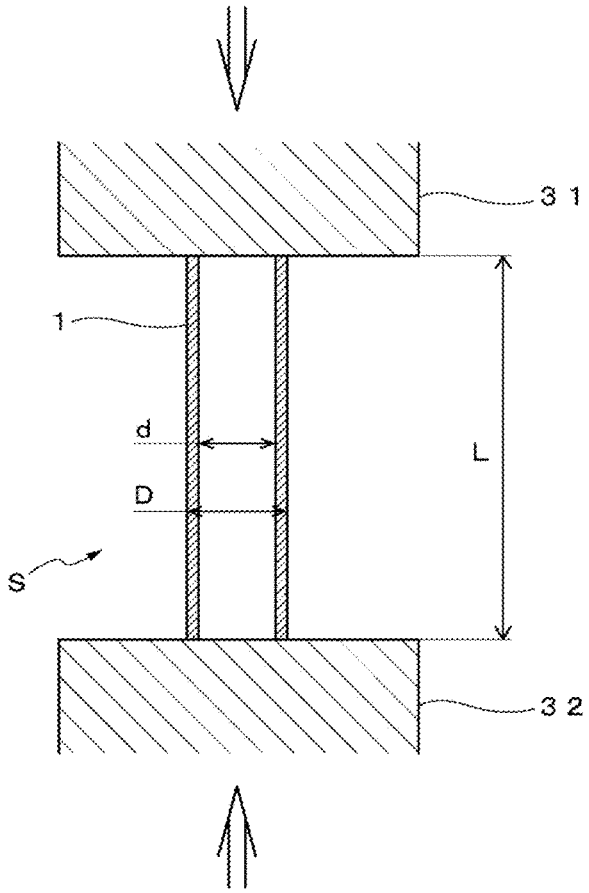
FIG. 5 is a schematic view showing a situation where measurement of degree of deformation of the ink reservoir tube is performed with a compression testing machine.

For the measurements, a sample S is used that is a part of the ink reservoir tube 1 excluding the press-fit portion 1*a*, having an axial length of 20 mm, as shown in FIG. 5. The results are tabulated in Table 1, and a deformation load is the load at which the sample is defamed (buckled) by the applied load onto the sample as indicated by an arrow, where both ends of the sample S are set vertically between upper and lower compression plates 31 and 32.

The sensory evaluation is ranked as follows:

Rank A: comfortable to write

Rank B: possible to write

Rank C: hard to write (At least one sample exists with which it is hard to write.)

As described above, refills for writing implements, that is, ballpoint pen refills, are selected ones having the defamation load to be equal to or more than 70 N and sensory evaluation scores as "Bending at writing" to be "A" and "B", as shown in verification results in Table 1.

For the refills for writing implements according to the present invention, aqueous ink to be stored in the ink reservoir tube 1 can be used whose viscosity under an environment temperature of 20 degrees C. ranges 100 mPa·s to 3000 mPa·s in a measurement at a shear rate of 3.8 l/s and ranges 20 mPa·s to 200 mPa·s in a measurement at a shear rate of 383 l/s. With this ink, ink consumption when writing at a writing speed of 4.5 m/min will be not more than 80 mg/100 m, favorably not more than 60 mg/100 m. In addition, by substantially increasing the inner diameter of the ink reservoir tube, a variation in ink length in the ink reservoir tube per 100 m of writing length can be set to be not more than 10 mm. Even in a case of large flow amount of ink, ink consumption, due to continuous writing, moving speed of ink in the ink reservoir tube can be properly controlled and ink in the ink reservoir tube can follow the flow of ink; a good writing performance without blurring at writing can be achieved.

Figure 6:
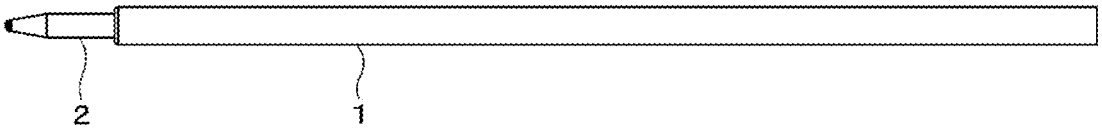
FIG. 6 is an outside drawing of a second embodiment of a ballpoint pen refill.
Figure 7:
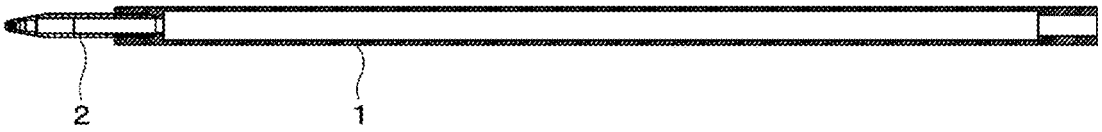
FIG. 7 is a central cross-sectional view of the ballpoint pen refill shown in FIG. 6.
Figure 8:
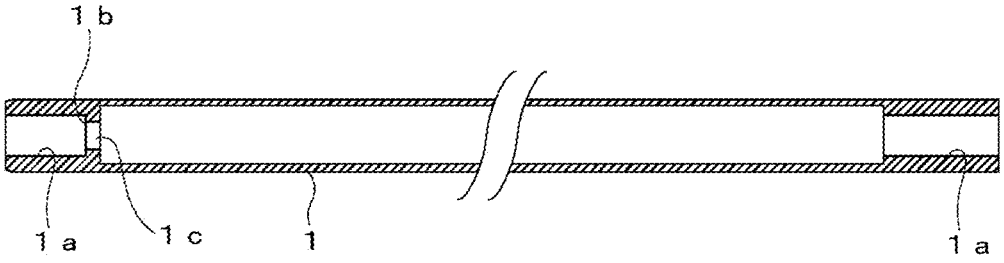
FIG. 8 is a central cross-sectional view of an enlarged single unit of an ink reservoir tube shown in FIG. 6.
Figure 9:
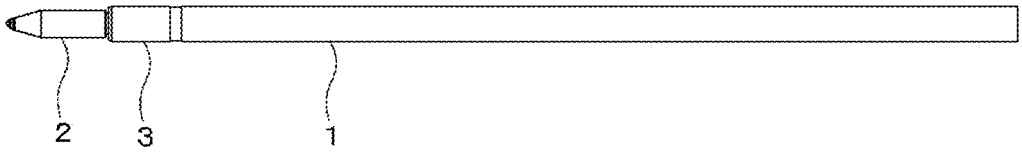
FIG. 9 is an outside drawing of a third embodiment of a ballpoint pen refill.
Figure 10:
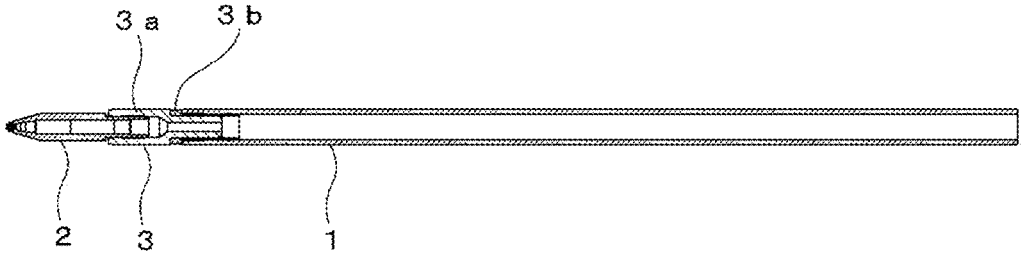
FIG. 10 is a central cross-sectional view of the ballpoint pen refill shown in FIG. 9.

FIGS. 6 to 8 show a second embodiment of a refill for writing implement, such as a refill for ballpoint pen, according to the present invention. In those refills, a ballpoint pen tip is directly attached press-fittedly to an ink reservoir tube without using a joint member at a front end of the ink reservoir tube 1.

The ink reservoir tube in the second embodiment is also made of resin material including propylene homopolymers and formed to a cylindrical shape. As shown enlargedly in FIG. 8, both ends of the ink reservoir tube are thickened toward an inner circumferential surface and a press-fit portion 1*a* is respectively formed having an opening bore penetrating in an axial direction.

In addition, in the second embodiment, at the press-fit portion 1*a* at the front end of the ink reservoir tube 1, an abutting portion 1*b* having an axial opening 1*c* having a narrower diameter than that of the opening bore constituting the press-fit portion 1*a*, at a center side of the ink reservoir tube 1. As shown in FIG. 7, when a ballpoint pen tip 2 is press-fitted, the abutting portion 1*b* performs a function of a positioning as a stopper by abutting with a rear end of the ballpoint pen tip 2. Consequently, with the above-described configuration of the ink reservoir tube 1, no step-like portion for positioning that abuts with the end of the ink reservoir tube is necessary to be formed on an outer circumferential surface of the ballpoint pen tip 2.

For the ballpoint pen refills according to the second embodiment shown in FIGS. 6 to 8, ink having properties equivalent to those in the first embodiment can be used, and

TABLE 1

| | Comparative example 1 | Comparative example 2 | Embodiment 1 | Embodiment 2 | Embodiment 3 | Embodiment 4 | Embodiment 5 |
|---|---|---|---|---|---|---|---|
| Outer diameter D (mm) | 3.0 | 2.9 | 3.0 | 3.0 | 3.1 | 3.1 | 3.1 |
| Thickness t (mm) | 0.3 | 0.3 | 0.3 | 0.4 | 0.4 | 0.4 | 0.4 |
| $D^4 - (D - 2t)^4$ | 41.8* | 42.7 | 47.8 | 53.1* | 61.9 | 64.4 | 66.6* |
| Deformation Load (N) | 63.7 | 66.9 | 73.8 | 86.5 | 97.4 | 111.1 | 124.2 |
| Bending at writing | C | C | B | B | A | A | A |

Deformation loads N in Table 1 are averaged values of 10 samples S of each of two comparative examples and five embodiments. It is verified that the deformation load of more than 70, or favorably more than 90 does not affect to writing. In addition, this is also supported by the results in Table 1 further added with a sensory evaluation of "Bending at writing" of writing by the present inventor.

the refills are selected from those that meet the requirements shown as Embodiments 1 through 5 in Table 1. This results that refills for writing implements performing the equivalent action and effect as that of the first embodiment can be provided.

FIGS. 9 to 13 show a third embodiment of refills for writing implements (ballpoint pen refills) according to the present invention. The refills shown in FIGS. 9 to 13 are aimed to provide those that enable to secure a sufficient amount of ink stored and a sufficient connecting force between the ink reservoir tube and the joint member, by making the wall thickness of the ink reservoir tube thinner.

At one end, a front end, of the ink reservoir tube famed in a cylindrical shape made of the resin material including polypropylene monomer, a joint member 3 is press-fittedly attached and a ballpoint pen tip 2, formed of metal or resin material, is attached through the joint member 3. The ballpoint pen refill according to the present embodiment uses an ink reservoir tube having a thinner wall thickness, compared to a conventional ballpoint pen refill shown in FIG. 17. Consequently, with this embodiment, a sufficient amount of ink stored can be available without increasing the outer diameter of the ink reservoir tube 1.

Figure 11:
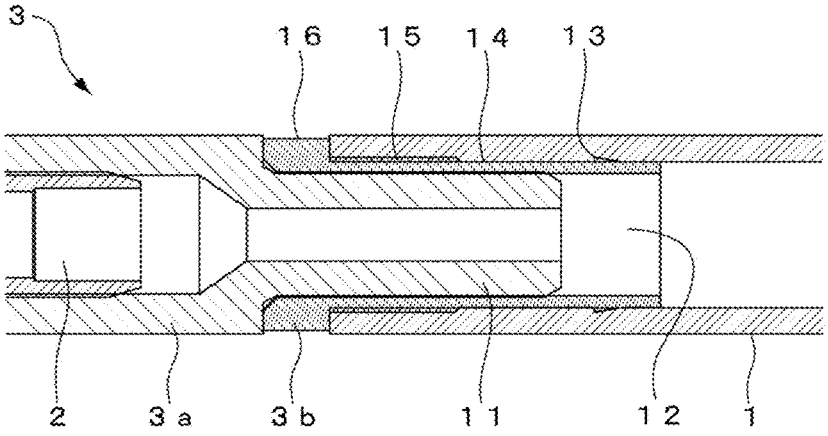
FIG. 11 is a partially enlarged cross-sectional view of a joint member of the ballpoint pen refill shown in FIG. 9.

As enlargedly shown in FIG. 11, the joint member 3 is composed of a first joint member 3*a* and a joint member receiving seat 3*b*; a ballpoint pen tip 2 is attached to the first joint member 3*a* by press-fitting a rear end of the ballpoint pen tip 2, and a joint member receiving seat 3*b* is press-fitted to an outside of a reduced diameter portion 11 of the first joint member 3*a*.

The joint member is constructed as the appearance to be approximately cylindrical by including an axial bore 12 with which the reduced diameter portion 11 of the first joint member 3*a* is press-fitted at the joint member receiving seat 3*b*; the joint member receiving seat 3*b* is renamed a second joint member hereinafter.

Figure 12:
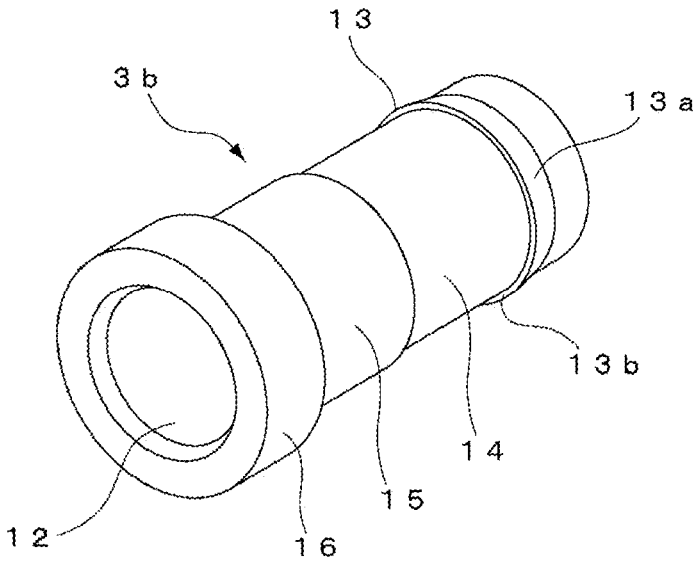
FIG. 12 is a perspective view of an enlarged single unit of joint member receiving seat constituting a joint member.
Figure 13:
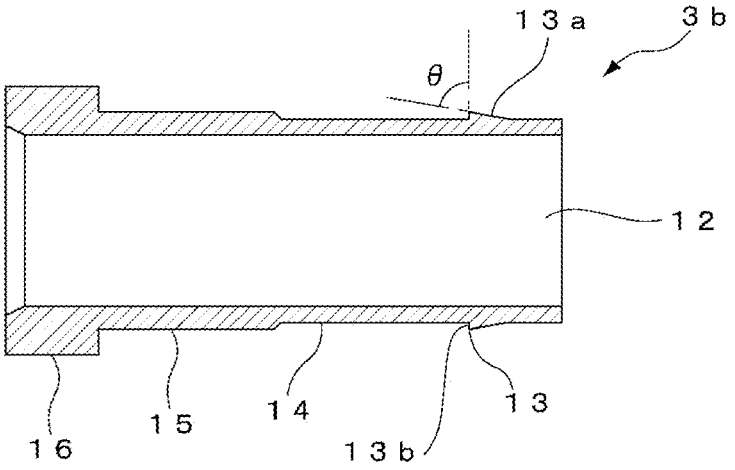
FIG. 13 is a central cross-sectional view of the joint member receiving seat constituting a joint member.

The joint member 3 is formed of two members, that is, the first joint member and the second joint member, and therefore the first joint member 3*a* can be made of resin material and the second joint member 3*b* can be made of metal material, for example. A single unit of the second joint member made of metal material, brass for example, is shown in FIGS. 12 and 13. At an end of the second joint member 3*b* which is to be inserted to the ink reservoir tube, an edge portion 13 is formed protruding annularly on the outer circumferential surface. The edge portion 13 composed of a taper-like inclined surface 13*a* whose outer diameter gradually increases toward foremost of the writing tip 2 and a falling face 13*b* whose outer diameter decreases, being continuous from the inclined surface.

An intersection angle of the taper-like inclined surface 13*a* and the falling face 13*b* in a cross-section along the axial direction is set favorably to be an acute angle, less than 90 degrees. For an example, an inclination angle against the axis on a cross-sectional plane of the taper-like inclined surface 13*a* in FIG. 13 is set to be 20 degrees and the falling face 13*b* is set to be parallel to a plane perpendicular to the axis. Thus the intersection angle θ of the taper-like inclined surface 13*a* and the falling face 13*b* at the edge portion 13 of this embodiment is set 70 degrees.

On the second joint member 3*b*, in succession to the edge portion 13 famed are a first cylindrical surface and a second cylindrical surface 15, whose diameters are increasing stepwise toward the ballpoint pen tip 2, and a annular flange portion 16; an outer diameter of the annular flange portion 16 is set to be approximately the same as the outer diameter of the ink reservoir tube and the first joint member shown in FIG. 11. That is, the first cylindrical surface and the second cylindrical surface, whose diameters increase stepwise, function as a connecting part with the ink reservoir tube 1.

When a connected body of the ballpoint pen tip 2 and the joint member 3 is press-fitted to a front edge of the ink reservoir tube 1, an inner surface of the front edge of the ink reservoir tube 1 is attached overriding the edge portion 13 formed on the second joint member 3*b*. In this case, because a taper-like surface 13*a* is formed at the edge portion 13 toward the ink reservoir tube 1, joint member 3 is relatively easily attached to the front edge of the ink reservoir tube 1, utilizing flexibility of the ink reservoir tube 1.

In a situation as shown in FIG. 11 where the connected body of the ballpoint pen tip 2 and the joint member 3 is press-fitted to a front edge of the ink reservoir tube 1, since the joint member 3, particularly the second joint member 3*b*, is made of material having higher hardness than that is used for the ink reservoir tube 1, metal material such as brass or stainless steel or non-iron metal material such as aluminum, the edge portion 13 formed on the joint member 3 abuts with the inner surface of the ink reservoir tube made of resin material with biting; this achieves sufficient fitting between the joint member 3 and the ink reservoir tube 1.

Further, since the falling face 13*b* constituting the edge member 13 is famed facing toward the ballpoint pen tip, the falling face 13 locks the inner circumferential surface of the ink reservoir tube 1 effectively, and act to prevent the joint member 3 detaching from the ink reservoir tube 1. With this configuration, a refill for writing implements can be provided that allows surely preventing the writing tip 2 detaching from the ink reservoir tube 1.

Although in a third embodiment an example is shown where a ballpoint pen tip 2 is attached to a front edge of a ink reservoir tube 1 through a joint member 3, this invention can be applied to a construction in which the ballpoint pen tip is directly attached to the front edge of the ink reservoir tube without using the joint member 3.

In the third embodiment, the first joint member 3*a* and the second joint member 3*b* are made of different material, but a form can be adopted in which the first joint member 3*a* and the second joint member 3*b* are integrated to be a joint member 3.

For the ballpoint pen refills according to the third embodiment shown in FIGS. 9 to 13, ink having properties equivalent to those in the first embodiment can be used, and the refills are selected from those that meet the requirements shown as Embodiments 1 through 5 in Table 1. This results that refills for writing implements performing the equivalent action and effect as that of the first embodiment can be provided.

Figure 1:
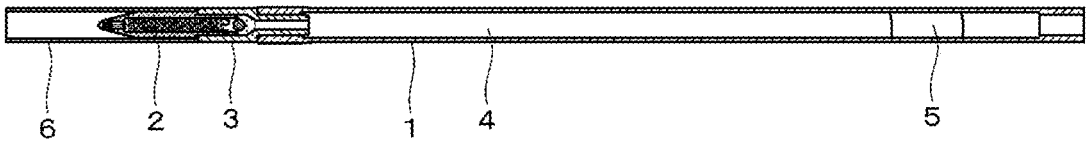
FIG. 1 is a central cross-sectional view of a first embodiment according to the present invention where a refill for a writing implement is applied as a ballpoint pen refill.
Figure 14:
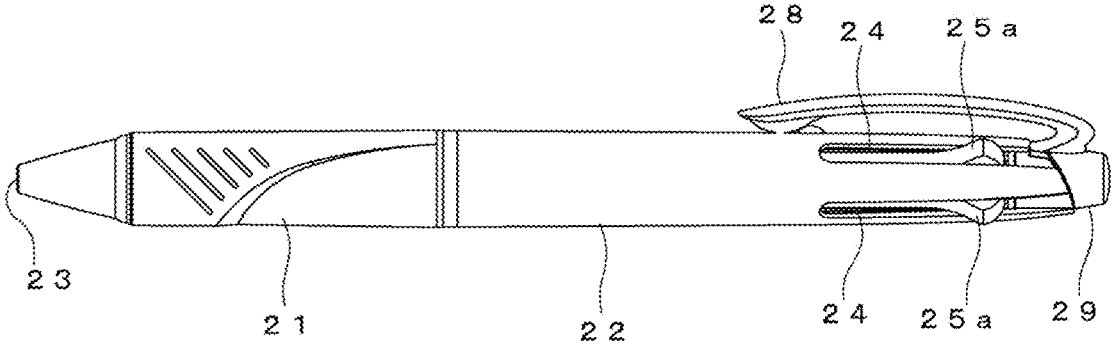
FIG. 14 is an outside drawing of an example adopting a refill for writing implement according to the present invention to a multiple writing implement.
Figure 15:
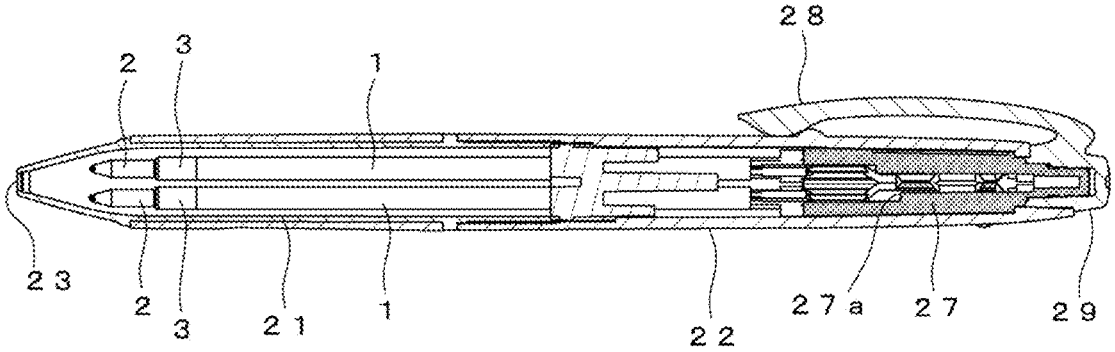
FIG. 15 is a central cross-sectional view of the multiple writing implement shown in FIG. 14.
Figure 16:
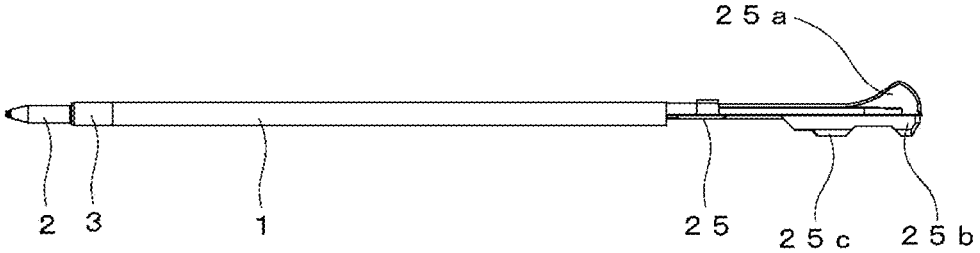
FIG. 16 is an enlarged outside drawing of a constitution of a combination of a slider and a ballpoint pen refill provided in a multiple writing implement.

FIGS. 14 to 16 show an example of a multicolor ballpoint pen using refills according to the present invention, in the figure example the ballpoint pen refills shown in FIG. 1 are used. In the multiple-color ballpoint pen a barrel is composed of a front barrel 21 and a rear barrel 22, and a tip end of the front barrel reduces in diameter in a corn shape to form a tip opening 23. A writing tip 2, a ballpoint pen tip, of one of the ballpoint pen refills is alternatively selected and protruded out through the tip opening 23.

At a rear end of the rear barrel 22, a plurality of guide slits 24, four slits in this example, are formed. An operation portion 25*a* formed on a slider 25 in each of the guide slits 24 is disposed slidably along an axis of the barrel respectively, protruding outward of the rear barrel.

The rear barrel 22 in which the guide slits 24 are formed houses an inner cylinder 27 on which a locking face 27*a* that locks the slider 25 in an advanced state. A rear end of the inner cylinder 27 with a slightly thinner diameter protrudes from a rear end of the rear barrel 22. A cap member 29 that is integrally formed with a clip 28 is fittingly attached to cover the protruding portion of the inner cylinder 27.

The front end of the slider 25 is attached to the press-fit portion 1*a* (See FIG. 3) having a thickened thickness formed at a rear end of the ink reservoir tube 1. A returning spring (not shown) is disposed so as to surround each of the ink reservoir tubes 1 and the sliders 25; with this configuration, the respective ink reservoir tube 1 and slider 25 are disposed in a state being energized toward the rear direction of the axis of the multicolor ballpoint pen.

When, in this state, any one of the sliders 25 is advanced using the operating portion 25*a*, the operating portion 25*a* of the slider 25 moves forward along the guide slit formed on the inner cylinder to be dropped in an axial center direction, whereby the operating portion 25*a* of the slider 25 is locked on the locking face 27*a* formed in the inner cylinder 27. In this instance, the refill attached to the slider 25 properly bent due to its flexibility and the ballpoint pen tip 2 at the tip end is held in a state protruding from the tip opening 23.

When, in this state, another second slider 25 is advanced, a lock release cam 25*c*, formed on the second slider 25, abut to a protrusion 25*b* to be pressed of the first slider 25 that has been locked in an advanced state and pushes it out, whereby the lock state of the first slider 25 is released. As a result, the first slider retracts due to the action of the return spring, the rear locking portion 25*b* of the second slider 25 is locked on a locking face 27*a* formed on the inner cylinder 27; thus exchange of ballpoint pen tips 2 being protruded out from the tip end 23 is achieved.

To exchange the ballpoint pen refills of this kind of writing implements, an operation is performed that the refill is removed by pulling out the rear end of the ink reservoir tube 1 that is attached by fitting to In the above situation a user often pulls out the ink reservoir tube from the slider 25 of the barrel side, pinching the ballpoint pen tip 2 at the tip end of the refill.

Therefore it is preferable that fitting force of a connecting portion between the writing tip or a joint member 3 supporting the writing tip and the ink reservoir tube 1 is set stronger than the fitting force of a connecting portion between the slider 25 of the barrel and the ink reservoir tube 1. This can achieve to avoid a problem of unintended ink leaking, due to disconnection at the connecting portion between the writing tip 2 or the joint member supporting the writing tip and the ink reservoir tube 1.

In a multi-color ballpoint pen shown in FIGS. 14 to 16, refills for writing implements, such as ballpoint pen refills containing different color inks, black, red, blue, and green for example, are housed in a barrel. Generally speaking, black ink is most frequently used, and other three colors are used less. As for each of ink reservoir tubes 1 of refills for writing implement has the same dimension in outer diameter and length, and by making the thickness of the ink reservoir tube for black ink thinner, writing length of the black ink refill can be set to be longer. Further the black ink described here is conformed to the standards of ISO27668, and written lines that were drawn at a writing speed of 4.5 m/s at an angle of 60 degrees with a writing pressure of 1 N on paper have absorption in the entire wavelength range from 380 nm to 780 nm and show an L* value of 25 or less in CIE colorimetric system when colorimetry is performed in a D50 light source environment using a colorimetry method with an integrating sphere type spectrocolorimeter that does not include a specular reflection component.

That is, by setting the thickness of ink reservoir tubes properly according to frequency of use of respective color ink, replacement cycle of each color ballpoint pen refill (when the ink runs out) can be mutually adjusted. In this case, provided that let the writing distance be "one" (1) for the ballpoint pen refill of least frequent use of color, red for example; by adjusting the writing distance of most frequent use of color to be in a range of 1.5 to 2.5, the timing of replacement of each color ballpoint pen refill can be adjusted to a certain extent. This enables to exchange the ballpoint pen refills at a time with no waste without leaving a large amount of ink in the ballpoint pen refills of each color.

As cleared by the above explanation, according to the present invention, a necessary amount of ink can be stored by setting the relation between the outer diameter D (mm) and the thickness t (mm) thereof to be in a specific range, and also provided is a refill for writing implements with which one can continue writing comfortably without feeling of discomfort in writing.

In the above explanation, a ballpoint pen refill is described as an embodiment example, but the invention is applicable to other refills for writing implements having a writing tip other than ballpoint pen tip and the action and effect similar to those above can be available.

LIST OF REFERENCE NUMERALS ink reservoir tube
1*a* press-fit portion
1*b* abutting portion
1*c* axial opening
2 writing tip (ballpoint pen tip)
3 joint member
3*a* first joint member
3*b* second joint member (joint member receiving seat)
4 ink
5 follower
6 cap
7 writing ball
8 spring
9 backflow preventing ball
11 reduced diameter portion
12 axial bore
13 edge portion
13*a* taper-like inclined surface
13*b* falling face
14 first cylindrical surface
15 second cylindrical surface
16 portion
21 front barrel
22 rear barrel
23 tip opening
24 guiding slit
25 slider
27 inner cylinder
28 clip
29 cap
31 upper compression plate
32 lower compression plate
S sample (ink reservoir tube)

The invention claimed is:

1. A refill for writing implements, comprising:

an ink reservoir tube made of resin material and formed as a straight cylinder; and a writing tip attached to one end of the ink reservoir tube, wherein a value of an expression of $D^4-(D-2t)^4$ is 45 or greater, where D denotes an outer diameter of the ink reservoir tube and t denotes a thickness of the ink reservoir tube, and further comprising:

a press-fit portion formed at the end of the ink reservoir tube including the ink reservoir tube being thickened toward an inner circumferential surface, and a penetrating opening disposed at a central portion of the press-fit portion in an axial direction, and wherein the writing tip or a joint member supporting the writing tip is attached by press-fitting into the press-fit portion.

2. The refill for writing implements according to claim 1, further including the joint member supporting the writing tip on the inner circumferential surface at the end of the ink reservoir tube, and a back-flow preventing mechanism provided in the joint member.

3. The refill for writing implements according to claim 1, wherein a polypropylene polymer is contained as a composition component of the ink reservoir tube.

4. The refill for writing implements according to claim 1, wherein the thickness of the press-fit portion ranges 0.5 mm to 0.7 mm, and a length along an axis of the press-fit portion ranges 1 mm to 6 mm.

5. A writing implement, comprising:

a barrel; and a plurality of refills for writing implements described in claim 1 housed in the barrel, wherein one writing tip of the plurality of refills for writing implements is configured to be alternatively selected and protruded out through the tip opening of the barrel.

6. A writing implement, comprising:

a barrel; and a refill for writing implements described in claim 1 housed in the barrel, wherein a fitting force between the writing tip or the joint member supporting a writing tip and a connecting portion of the ink reservoir tube is set to be larger than fitting a force between the ink reservoir tube and a connecting portion of the ink reservoir tube with the barrel.

7. The writing implement according to claim 5, wherein a plurality of refills for writing implements are housed in the barrel and an outer diameter and total length of each of the plurality of refills for writing implements are set equal, and a ratio of writing distances of respective refills are set to range from 1.5 to 2.5 by varying the thickness of each of the plurality of refills for writing implements.

8. A writing implement, comprising:

a barrel; and a plurality of refills for writing implements described in claim 1 housed in the barrel, wherein one writing tip of the plurality of refills for writing implements is configured to be alternatively selected and protruded out through the tip opening of the barrel.

9. A writing implement, comprising:

a barrel; and a plurality of refills for writing implements described in claim 2 housed in the barrel, wherein one writing tip of the plurality of refills for writing implements is configured to be alternatively selected and protruded out through the tip opening of the barrel.

10. A writing implement, comprising:

a barrel; and a plurality of refills for writing implements described in claim 3 housed in the barrel, wherein one writing tip of the plurality of refills for writing implements is configured to be alternatively selected and protruded out through the tip opening of the barrel.

11. A writing implement, comprising:

a barrel; and a plurality of refills for writing implements described in claim 4 housed in the barrel, wherein one writing tip of the plurality of refills for writing implements is configured to be alternatively selected and protruded out through the tip opening of the barrel.

12. A writing implement, comprising:

a barrel; and a refill for writing implements described in claim 1 housed in the barrel, wherein a fitting force between the writing tip or the joint member supporting a writing tip and a connecting portion of the ink reservoir tube is set to be larger than a fitting force between the ink reservoir tube and a connecting portion of the ink reservoir tube with the barrel.

13. A writing implement, comprising:

a barrel; and a refill for writing implements described in claim 2 housed in the barrel, wherein a fitting force between the writing tip or the joint member supporting a writing tip and a connecting portion of the ink reservoir tube is set to be larger than a fitting force between the ink reservoir tube and a connecting portion of the ink reservoir tube with the barrel.

14. A writing implement, comprising:

a barrel; and a refill for writing implements described in claim 3 housed in the barrel, wherein a fitting force between the writing tip or the joint member supporting a writing tip and a connecting portion of the ink reservoir tube is set to be larger than a fitting force between the ink reservoir tube and a connecting portion of the ink reservoir tube with the barrel.

15. A writing implement, comprising:

a barrel; and a refill for writing implements described in claim 4 housed in the barrel, wherein a fitting force between the writing tip or the joint member supporting a writing tip and a connecting portion of the ink reservoir tube is set to be larger than a fitting force between the ink reservoir tube and a connecting portion of the ink reservoir tube with the barrel.

* * * * *